US005494058A

United States Patent [19]

Chan

[11] Patent Number: 5,494,058

[45] Date of Patent: Feb. 27, 1996

[54] HAIR CURLING IRON

[75] Inventor: Wing-Kin Chan, Kowloon, Hong Kong

[73] Assignee: China Pacific Trade Ltd., Virgin Islands (Br.)

[21] Appl. No.: 207,065

[22] Filed: Mar. 8, 1994

[30] Foreign Application Priority Data

Feb. 10, 1994 [GB] United Kingdom ..... 9402558

[51] Int. Cl.[6] ..... A45D 1/04

[52] U.S. Cl. ..... 132/228; 132/229; 132/272; 219/226

[58] Field of Search ..... 132/228, 227, 132/226, 223, 229, 272; 219/225, 226

[56] References Cited

U.S. PATENT DOCUMENTS

| | | | |
|---|---|---|---|
| 3,773,057 | 11/1973 | Johansen | 132/33 |
| 3,934,597 | 1/1976 | McNair | 132/37 |
| 4,029,110 | 6/1977 | Hyland | 132/33 |
| 4,267,851 | 5/1981 | Plaisted | 132/33 |
| 4,326,545 | 4/1982 | Motesi | 132/33 |
| 4,419,565 | 12/1983 | McGaw | 132/229 X |
| 4,456,815 | 6/1984 | Andis | 219/225 |
| 4,569,360 | 2/1986 | Glucksman | 132/226 |
| 4,661,683 | 4/1987 | Glucksman | 219/222 |
| 4,695,704 | 9/1987 | Andis | 219/225 X |
| 4,936,027 | 6/1990 | Tsuji | 34/90 |
| 5,212,366 | 5/1993 | McDougall | 219/222 |

FOREIGN PATENT DOCUMENTS

| | | |
|---|---|---|
| 1423501 | 2/1976 | United Kingdom . |
| 2241434 | 4/1991 | United Kingdom . |

*Primary Examiner*—John G. Weiss
*Attorney, Agent, or Firm*—Burns, Doane, Swecker & Mathis

[57] ABSTRACT

A hair curling iron comprises an air heater and a blower disposed in a handle portion and a steam generator disposed in a barrel extending from the handle portion. The steam generator includes a water carrying member and a heating element. The barrel includes apertures for heated air and steam. The water carrying member is movable axially in the barrel to contact an end of the heating element. The curling iron may be used in conjunction with a metal roller having a metal roller body and a pair of plastic end pieces.

6 Claims, 3 Drawing Sheets

HAIR CURLING IRON

FIELD OF THE INVENTION

This invention relates to a hair iron, and in particular to a hair iron which combines the features of a hair curling iron which is designed to be applied to a hair roller when placed in situ, and a steam generating hair iron.

BACKGROUND OF THE INVENTION

There are known in the prior art hair curling irons which are designed to be used in conjunction with hair rollers. In use the roller is placed in the hair at desired locations and hair is wound tightly around the roller. A barrel element of the curling iron is inserted in the roller and supplies heat to the roller and hair by means of hot air. The hair iron may include a heater/blower assembly which directs hot air along the barrel from whence it is allowed to escape through apertures in the barrel to the roller and hair wound thereon. An example of such a prior arrangement is shown in GB 2241434A.

Also known in the art are hair curling irons in which heat is supplied to the hair in the form of steam, the dampness of which also assists in the forming of the desired curl. For example the curling iron may include a barrel element around which the hair is wound, and within which is provided a source of steam which may be applied to the hair wound around the barrel.

SUMMARY OF THE INVENTION

An object of the present invention is to provide a further improvement over such existing curling irons, and in particular to provide a single curling iron having a wider range of functions and features than known curling irons, thus providing a curling iron having greater versatility than existing known curling irons.

According to the present invention therefore there is provided a hair curling iron comprising, a handle portion having an elongate barrel extending from one end thereof, said handle portion including a heater/blower assembly therein adapted to direct in use hot air along said barrel, and said barrel comprising a first set of apertures for the discharge of such hot air, and steam generating means located in said barrel, said barrel being provided with a second set of apertures for the discharge of steam produced by said steam generating means.

Preferably the steam generating means comprises a water container, a heating element, and means for directing water into contact with the heating element. In a preferred embodiment there is provided a water retaining member, and means for moving said water retaining member into contact with said heating element when it is desired to generate steam. For example the water retaining member may comprise a sponge-like member that is retained within the barrel and which may be moved axially along the barrel into and out of Contact with the heating element, preferably against a spring bias that acts to bias the sponge-like member out of contact with heating element.

Preferably the first set of apertures for the hot air are larger than the second set of apertures for the steam generated by the steam generating means.

The heating element for the steam generating means may preferably be an electric heating element, for example a positive temperature control (PTC) heating element, and is located within the barrel. The electric heating element, and the heater/blower assembly may all be powered from a single power source, either a battery received within the handle portion, or alternatively a main power connection.

As discussed above the curling iron of the present invention is of particular, though not exclusive, applicability to an arrangement in which the curling iron in use is to be moved from roller to roller located in situ. In such conventional arrangements the rollers are normally formed of a plastics material, but plastics materials are not ideally suited for such applications since they neither conduct nor retain heat well. Metal rollers have in the past been proposed, but they have had a number of disadvantages. For example hot metal rollers can be difficult to handle, and can cause discomfort if they were to come into contact with a user's scalp.

According to the present invention therefore there is provided a hair roller comprising a generally cylindrical metal roller body, an end piece being provided at each end of the metal roller body, said end pieces being formed of a plastics material and having a maximum dimension normal to the roller axis which is greater than the roller diameter. Preferably for example the end pieces are circular and have a diameter greater than the diameter of the metal roller body. The provision of the plastic end pieces provide means to allow the roller to be easily handled, and reduce the likelihood of the roller accidentally coming into contact with a user's skin or scalp.

The roller body may include a number of apertures for the passage of hot air therethrough. Preferably also means are provided to facilitate engagement of hair on the roller, and such means may be removeable and replaceable. Preferably such engagement means comprise at least one plastic engagement member, for example in the form of an elongate element that may be secured to the roller body so as to extend parallel to the axis thereof and being formed with a series of hair engaging projections. Preferably the engagement member is secured to the roller body by a number of locking members formed on the engagement member and which are locatable in locking openings formed in the roller body.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENTS

Figure 1:
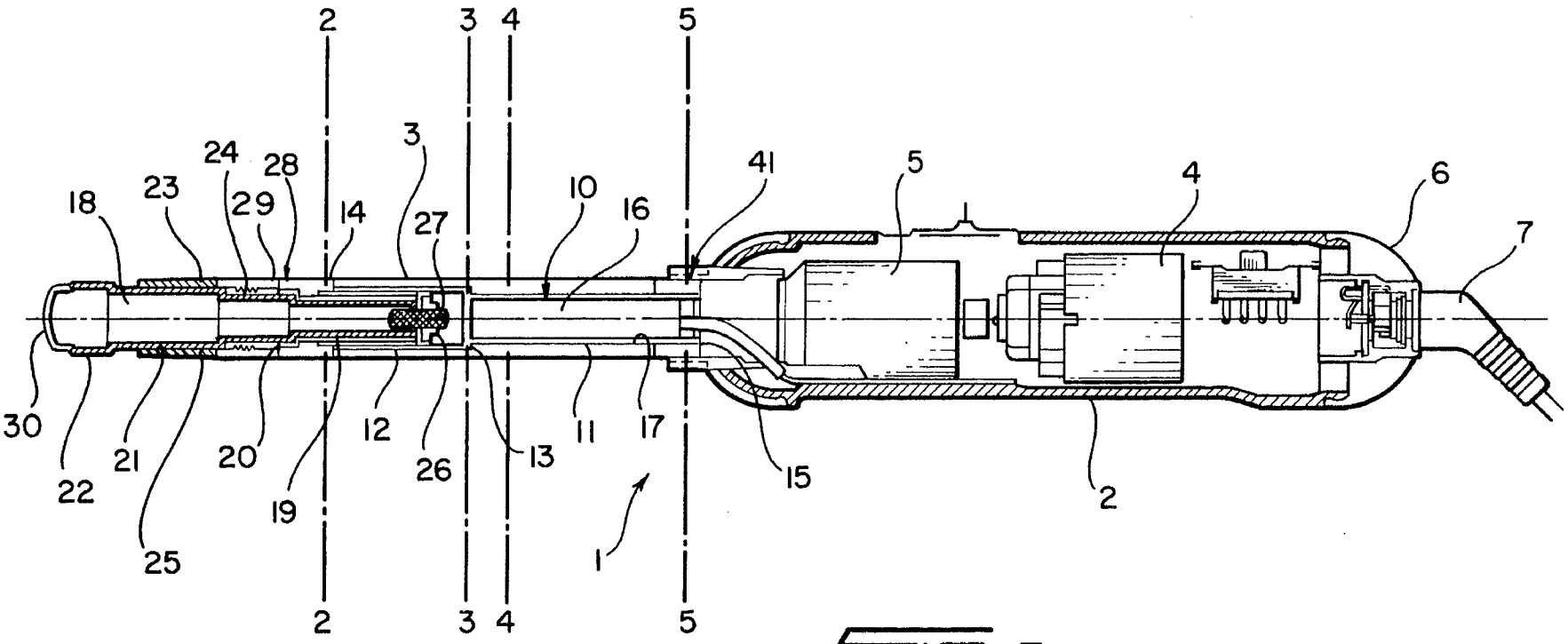
FIG. 1 is a side view in section of a curing iron according to an embodiment of the invention.
Figure 2:
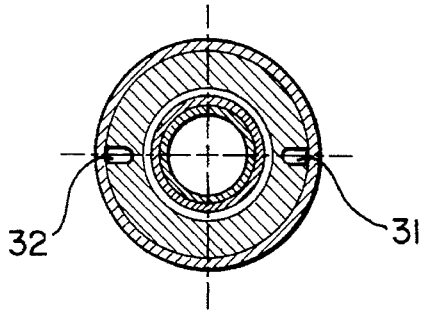
FIG. 2 is a section along line 2—2 in FIG. 1.
Figure 3:
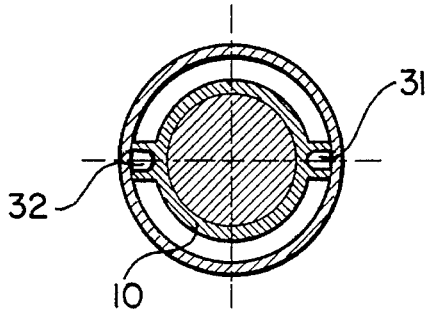
FIG. 3 is a section along line 3—3 in FIG. 1.

Referring firstly to FIG. 1 there is shown a hair curling iron 1. The hair curling iron 1 comprises a handle portion 2 and a generally hollow elongate barrel 3 extending from one end of the, handle portion 2 and along the central axis of the handle portion 2. Within the handle portion 2 are provided a fan 4 and a heater 5 whose functions will be described further below. The rear end of the handle portion 2, ie the end remote from the barrel 3, is provided with an air inlet grill 6, and a power connection 7 whereby the curling iron may be connected to a source of main power. As an alternative, or in addition, to providing a main power connection 7, the handle portion may also be provided with a battery receiving portion, or an integral rechargeable battery.

In use of the hair curling iron 1, the fan 4 is adapted to draw air into the handle portion 2 through the rear air inlet grill 6, which air is subsequently heated by passing through heater 5, and the resultant hot air passes into the barrel 3 from where it is discharged through a plurality of apertures 8 in a manner to be further described below.

Figure 4:
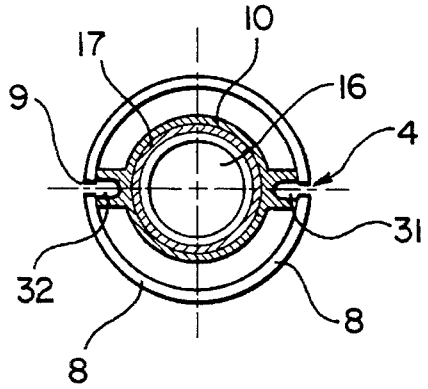
FIG. 4 is a section along line 4—4 in FIG. 1.
Figure 5:
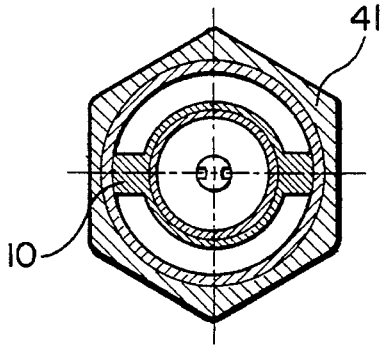
FIG. 5 is a section along line 5—5 in FIG. 1.

The barrel 3 is hollow and comprises a first set of apertures 8 (FIG. 4) over its surface for discharging the hot air generated by the fan 4 and heater 5 provided in the handle portion 2. The barrel also includes a second set of apertures 9, smaller in dimensions than the first set of apertures 8, for the discharge of steam generated by steam generating means provided within the elongate barrel 3. Within barrel 3 is provided a first tubular member 10, divided into a first section 11 and a second section 12 by a shoulder portion 13. The first tubular member 10 is sealingly located within the barrel 3 by a radially extending flange 14 provided at the end of the first tubular member 10 remote from the handle portion 2, and at the end adjacent the handle portion 2 by means of an annular sealing member 15.

Provided within the first section 11 of the first tubular member 10, i.e., the section closest to the handle portion 2, is a heating element comprising a PTC electric heating element 16 received within a cylindrical aluminium sleeve 17. Power for the PTC heating element is taken from the same source as for the fan 4 and heater 5, i.e., either from the main power connection 7 or from a battery.

Received within the end of the barrel 3 remote from the handle portion 2 is a water container 18. Water container 18 comprises four stepped tubular sections, the 19,20,21 and 22, the second 20 of which is provided on its external surface with a screw thread 23 that engages a complementary thread 24 on the internal surface of a sliding second tubular member 25 which is adapted to receive the first two sections 19,20 of the water container. The end of the first section 19 of the water container 18, i.e., the end of the water container located within the barrel 3, is provided with an opening 26 within which is fixedly located a water retaining member in the form of a sponge-like member 27. The water container 18 can be filled by opening the end 30 which is in the form of an openable cap.

Tubular member 25 is adapted to slide axially within the barrel 3 against a spring bias provided by spring 28 located between an annular rib 29 on the tubular member 25 and the flange 14 of the first tubular member. It will be appreciated therefore that when the external end 30 of the water container 18 is pressed the water container 18 and the second tubular member 25 move axially against the spring 28 until the sponge-like member 27 comes into contact with the end stirface of the aluminium sleeve surrounding the PTC heating element. In use the sponge-like member 17 retains water from the water container and when this contacts the aluminium sleeve water is evaporated to generate steam which is then discharged from the barrel 3 via axially parallel channels 31,32 formed on diametrically opposed sides of the first tubular member, and then through the second apertures 9 previously described. Once pressure on the end 30 of the water container is removed, the spring bias moves the sponge-like member 27 out of contact with the sleeve 17 of the heating element.

It will thus be seen that there is provided a hair curling iron that can direct heat to the hair either in the form of hot air generated by fan 4 and heater 5, or in the form of steam generated by contact of the sponge-like member with the end of the sleeve of heating element.

Figure 6:
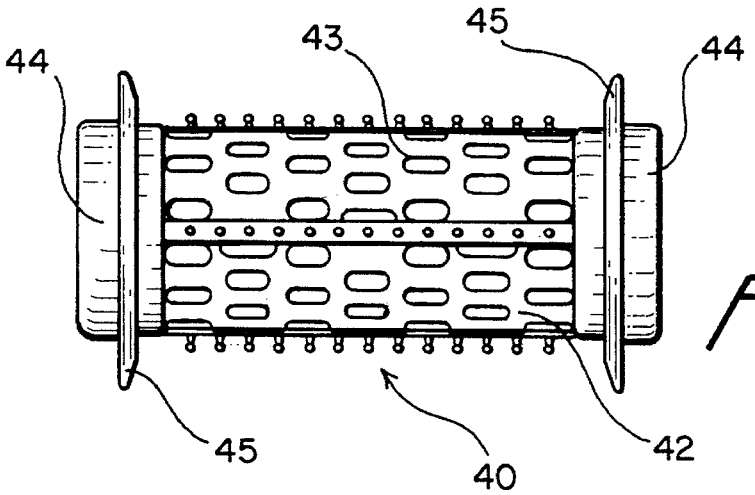
FIG. 6 is a side view of a metal hair roller according to an embodiment of the invention.
Figure 7:
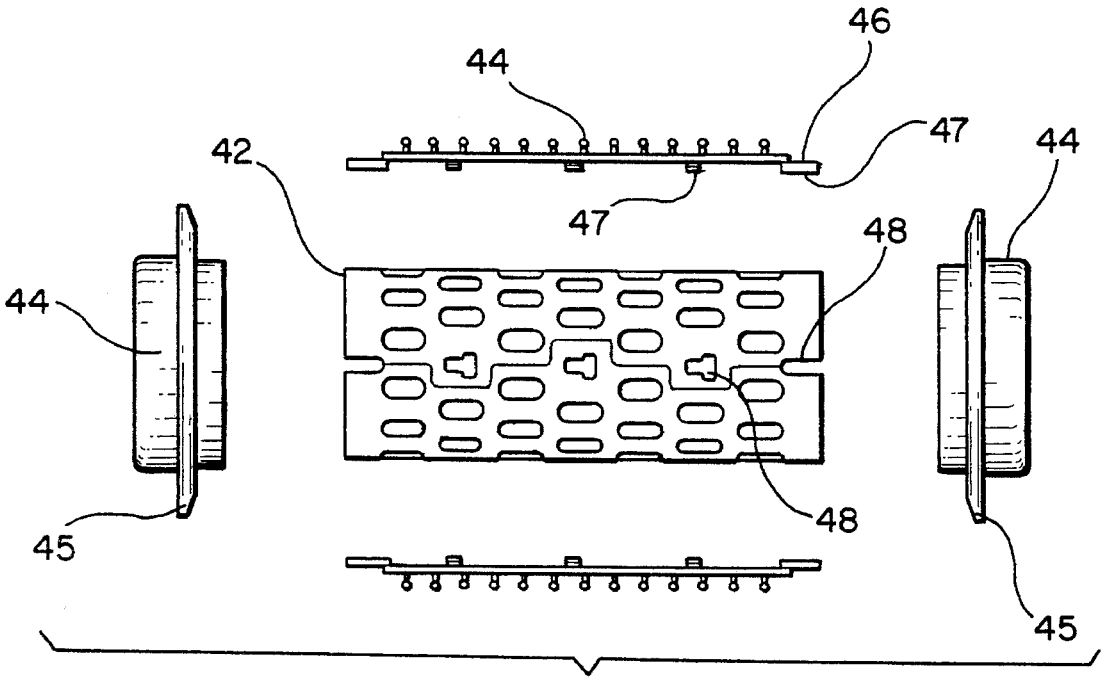
FIG. 7 is a view similar to FIG. 6 but in exploded form.
Figure 8:
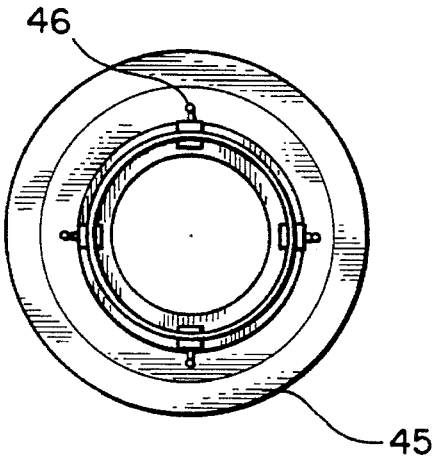
FIG. 8 is an end view of the roller of FIG. 6.

Such a hair curling iron may be used to apply heat to a roller already located in situ in a user's hair. Such a roller 40 is shown in FIGS. 6–8. In use the roller is located at a desired place in the hair, and then the barrel 3 of the iron is placed within the roller 40 and the iron is operated to generate heat, in the case of the present invention either by means of hot air or steam or both. To assist in location of the barrel 3 within the roller 40, surrounding the end of the barrel 3 where it meets the handle portion 2 is a tapering hexagonal projection 41 which may be received within a corresponding recess (not shown) formed in at least one end of the roller 40.

Referring to FIGS. 6–8 the roller 40 comprises a sheet of metal 42, such as thin steel, which is wound into cylindrical form. The roller is provided with a plurality of apertures 43 for the application of hot air and/or steam from the curling iron to hair wound around the roller. The ends of the roller 40 are provided with respective end pieces 44 made of a plastics material. The end pieces 44 are circular and have an annular radially outwardly extending flange 45 of a diameter substantially greater than the diameter of the roller, thus allowing the roller to be easily handled even though the metal may be hot, and also preventing the metal of the roller from accidentally coming into contact with the skin or scalp of a user.

To facilitate the engagement of hair around the roller, the roller 40 is provided with four plastic strips 46 that engage the roller through locking projections 47 receivable within locking apertures 48 provided in the metal roller 40. Each strip 46 is provided with a series of round-headed projections 49 adapted to assist in the engagement of hair about the roller. Preferably four such strips 46 are provided, one at each quarter around the roller, but it will readily be appreciated that a greater or smaller number may be provided as desired.

I claim:

1. Hair care apparatus comprising a hair curling iron, comprising a handle portion, an elongate barrel extending from one end of the handle portion, a heater/blower assembly disposed in the handle portion and adapted to direct heated air into said barrel, wherein said barrel comprises a water container located in the barrel at an end remote from said handle portion, a heating element disposed in the barrel, and a water retainer member in communication with said water container and movable axially along said barrel against a spring bias into contact with an end surface only of said heating element, said barrel including a first plurality of air discharge apertures for the discharge of heated air from the heater/blower assembly, the air discharge apertures being disposed in spaced relation about an entire circumference of said barrel and including a second plurality of apertures for the discharge of steam, the second plurality of apertures disposed so that said air discharge apertures are separated into two groups, and a hair roller, said roller comprising a generally cylindrical metal roller body, and end piece being provided at each end of the roller body, said end pieces being formed of a plastics material and having a maximum dimension normal to the roller axis which is greater than the roller diameter, wherein the barrel is insertable axially in the roller.

2. Apparatus as claimed in claim 1 wherein said roller is provided with hair engagement means.

3. Apparatus as claimed in claim 2 wherein said hair engagement means is removeable and replaceable.

4. Apparatus as claimed in claim 2 wherein said hair engagement means comprises at least one elongate plastics strip fastenable to the roller body so as to extend parallel to an axis of the roller and being formed with a series of hair engaging projections.

5. A hair curling iron comprising:

a handle portion;

an elongate barrel extending from one end of the handle portion;

a heater/blower assembly disposed in the handle portion and adapted to direct heated air into said barrel, wherein said barrel comprises a water container located in the barrel at an end remote from said handle portion, a heating element disposed in the barrel, and a water retaining member in communication with said water container and movable axially along said barrel against a spring bias into contact with an end surface only of said heating element, said barrel including a first plurality of air discharge apertures for the discharge of heated air from the heater/blower assembly, the air discharge apertures being disposed in spaced relation over an entire circumferential surface of said barrel and including a second plurality of apertures for a discharge of steam produced by contact of said water retaining member with said end surface of said heating element, the second plurality of apertures disposed on the surface of the barrel to separate said air discharge apertures into two groups.

6. A hair curling iron as claimed in claim 5 wherein the first set of apertures for the discharge of hot air are larger than the second set of apertures for the discharge of steam.

* * * * *